US006705892B2

(12) United States Patent
Kim

(10) Patent No.: US 6,705,892 B2
(45) Date of Patent: Mar. 16, 2004

(54) TERMINAL ASSEMBLY FOR COMPRESSOR

(75) Inventor: Tae-Hyung Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/347,632

(22) Filed: Jan. 22, 2003

(65) Prior Publication Data

US 2003/0139084 A1 Jul. 24, 2003

(30) Foreign Application Priority Data

Jan. 23, 2002 (KR) ..... 10-2002-3965

(51) Int. Cl.[7] ..... H01R 13/73
(52) U.S. Cl. ..... 439/542; 439/378
(58) Field of Search ..... 439/542, 527, 439/378

(56) References Cited

U.S. PATENT DOCUMENTS

| | | | | |
|---|---|---|---|---|
| 5,885,088 A | * | 3/1999 | Brennan et al. | 439/680 |
| 5,919,057 A | * | 7/1999 | Kameyama | 439/364 |
| 5,993,241 A | * | 11/1999 | Olson et al. | 439/378 |
| 6,331,122 B1 | * | 12/2001 | Wu | 439/567 |
| 6,520,686 B1 | * | 2/2003 | Kiani | 385/54 |

* cited by examiner

*Primary Examiner*—Gary Paumen
*Assistant Examiner*—James R. Harvey
(74) *Attorney, Agent, or Firm*—Fleshner & Kim, LLP

(57) ABSTRACT

The present invention relates to a terminal assembly for a compressor. In the terminal assembly 60 of the present invention, a connector 70, a PTC unit, a fuse unit and the like are installed within a terminal frame 61, and a cover 80 is mounted on the terminal frame 61 to shield the interior of the terminal frame. The connector 70 is mounted oil terminals 50, which are installed on an outer surface of a hermetic housing of the compressor, within the terminal assembly 60 so as to achieve electrical connection between the outside and inside of the compressor. The cover 80 is formed with restriction bosses 82, 83 for restricting detachment of the connector 70 from the terminals 50. The restriction bosses 82, 83 are formed at an interval corresponding to the length of the connector 70 in a vertical direction of the terminal assembly 60. Such restriction bosses 82, 83 prevent the detachment of the connector 70 even though the installation direction of the connector 70 is changed depending on arrangement of the terminals 50 on which the connector 70 is mounted. Accordingly, the connection state of the connector 70 with the terminals 50 can be more firmly maintained even while the terminal assembly 60 is commonly used for the reciprocating compressor and the linear compressor.

3 Claims, 4 Drawing Sheets

TERMINAL ASSEMBLY FOR COMPRESSOR

BACKGROUND OF THE INVENTION

1. Field of Invention

The present invention relates to a compressor, and more particularly, to a terminal assembly for supplying electric power to a compressor.

2. Description of the Prior Art

Compressors are used for compressing a working fluid such as a refrigerant and can be classified into a reciprocating compressor and a linear compressor according to an operating manner of a motor unit providing power for the compression of the working fluid. The reciprocating compressor is operated in such a manner that a crankshaft is rotated by means of rotation of the motor unit and the rotation of the crankshaft is converted into a linear reciprocating motion of a piston via a connecting rod or the like. The linear compressor is operated in such a manner that the motor unit itself performs a linear reciprocating motion to directly drive the piston.

Meanwhile, electric power should be supplied from the outside to the motor unit in order to drive such a compressor. FIG. 1 shows a general configuration of the reciprocating compressor for supplying external electric power to the compressor. Referring to the figure, a protector 12 is installed on an outer surface of a lower housing 10 constituting a part of a hermetic housing. The protector 12 is generally mounted on the lower housing 10 by means of spot welding. A terminal assembly 20 to be described later is mounted on the protector 12. A plurality of terminals 13 are provided at the center of the protector 12. The terminals 13 penetrate the lower housing 10 and are then electrically connected to additional connectors within the lower housing 10.

The terminal assembly 20 mainly comprises a terminal board 21, a positive temperature coefficient (PTC) unit 25 inserted into and mounted on the terminal board 21, and a fuse unit 29 inserted into and mounted on the terminal board 21.

For reference, the PTC unit 25 is constructed to include its own terminals and a PTC device interposed between the terminals so that an electric current can be interrupted according to whether the PTC device operates or not. The PTC device is configured to operate in the following manner. When the electric current flows in the PTC device, the device radiates heat and its resistance is increased. Such an increase of the resistance results in interruption of the electric current. When the temperature of the PTC device is lowered after the interruption, its resistance is decreased and the electric current flows again within a predetermined time.

The terminal board 21 is formed with a first mounting portion 22 and a second mounting portion 24 on which the PTC unit 25 and the fuse unit 29 are mounted, respectively. The first and second mounting portions 22, 24 are formed to penetrate the terminal board 21 so that portions of the PTC unit 25 and the fuse unit 29 can penetrate the terminal board and then be connected to the terminals 13, respectively. An additional cover (not shown) is installed on the terminal board 21 to shield the PTC unit 25 and the fuse unit 29.

In the meantime, there has been recently provided a terminal assembly capable of being used commonly for the reciprocating compressor and the linear compressor. That is, as shown in FIGS. 2*a* to 3*b*, a terminal frame 31 constructed to be seated in the protector 12 is provided with a connector 33 electrically connected to the terminals 13. Connection wires 34 for connecting the terminals 13 and the outside are connected to and installed in the connector 33. The PTC unit, the fuse unit and the like are seated in the terminal frame 31.

Further, a cover 40 is used to shield the terminal frame 31. An inner surface of the cover 40 is formed with a restriction boss 42 for maintaining a state where the connector 33 is connected to the terminals 13. The position of the restriction boss 42 approximately corresponds to the center of the connector 33, as well shown in FIG. 2*a*.

Meanwhile, the terminal assembly 30 can be commonly used even for the linear compressor. FIGS. 2*b* and 3*b* show a state where the terminal assembly 30 is used for the linear compressor.

Since the positions of the terminals 13 are changed in the linear compressor, the mounted position of the connector 33 is also changed. That is, as shown in FIG. 2*b*, the connection wires 34 of the connector 33 extend out from an upper left portion of the terminal frame 31 and then lead downward. In other words, although the direction in which the terminal frame 31 of the terminal assembly 30 is mounted is the same, the direction of the connector 33 provided in the terminal frame 31 is changed.

However, there is the following problem in the aforementioned prior art.

One kind of terminal assembly 30 can be commonly used for the reciprocating compressor and the linear compressor in the prior art. If the terminal assembly 30 is used for the linear compressor, however, only the direction of the connector 33 installed in the terminal assembly is changed and thus the position of the restriction boss 42 for preventing detachment of the connector 33 is changed.

Therefore, in case of the linear compressor, if an external force is exerted to the connection wires 34 extending from the connector 33 or an impact generated upon transport of the compressor is exerted thereto, the connector 33 escapes from the terminals 13 as shown in FIG. 3*b*. This is because the restriction boss 42 dose not correctly restrict the center of the connector 33 but restrict a position offset from the center of the connector 33 as shown in FIG. 2*b*.

In such a state, since the connection wires 34 are not electrically connected to the terminals 13, there is a problem in that the compressor cannot be started.

SUMMARY OF THE INVENTION

The present invention is conceived to solve the aforementioned problem in the prior art. An object of the present invention is to provide a terminal assembly of which a connector can be firmly installed therein even when being commonly used for a reciprocating compressor and a linear compressor.

According to an aspect of the present invention for achieving the object, there is provided a terminal assembly for a compressor, comprising a protector with terminals electrically connected to parts within the compressor; a connector mounted on the terminals for performing electrical connection between the terminals and connection wires; a terminal frame which is mounted on an outer surface of a hermetic housing of the compressor and in which the connector is seated; and a cover which is mounted on the terminal flame for shielding parts installed in the terminal frame and has restriction bosses for restricting detachment of the connector. At least two restriction bosses are formed at a predetermined interval on the cover so as to press down opposite ends of the connector even when the connector is placed at a rotated position within the terminal frame.

The interval between the restriction bosses may be smaller than a width between the opposite ends of the connector.

When the cover is mounted on the terminal frame, the restriction bosses may come into contact with the connector at a maximum length of the restriction bosses.

According to the terminal assembly for the compressor of the present invention constructed as such, there is an advantage in that even while one kind of terminal assembly is commonly used for compressors in which the positions of terminals are set to be different from each other, an installation state of the terminal assembly can be more firmly maintained.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, a preferred embodiment of a terminal assembly for a compressor according to the present invention will be described in detail with reference to the accompanying drawings.

Figure 1:
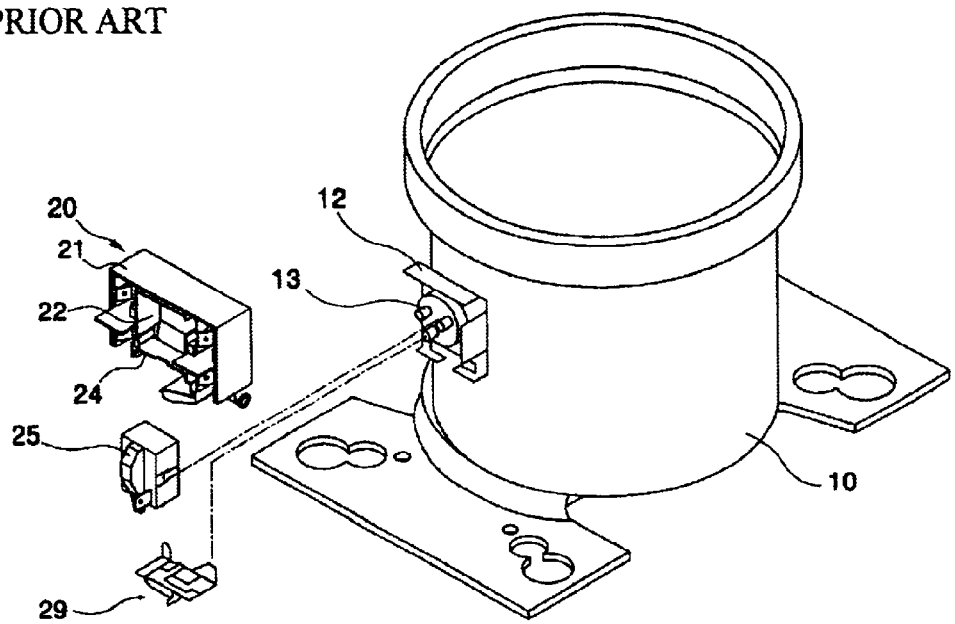
FIG. 1 PRIOR ART
FIG. 1 is an exploded perspective view showing a lower housing of a reciprocating compressor and a configuration of a terminal assembly mounted thereto in the prior art.
Figure 2A:
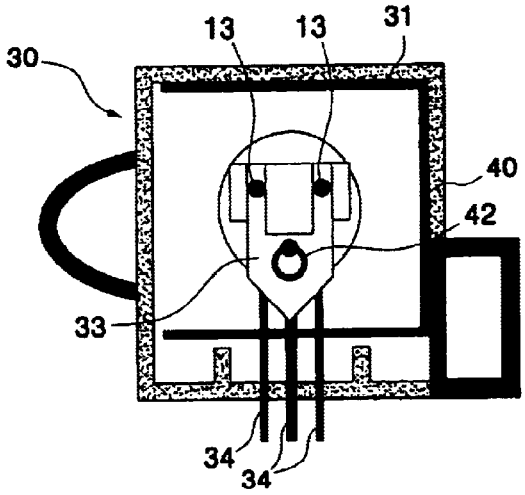
FIG. 2a PRIOR ART
FIG. 2*a* is a view schematically showing a configuration in which another conventional terminal assembly is mounted to the reciprocating compressor.
Figure 2B:
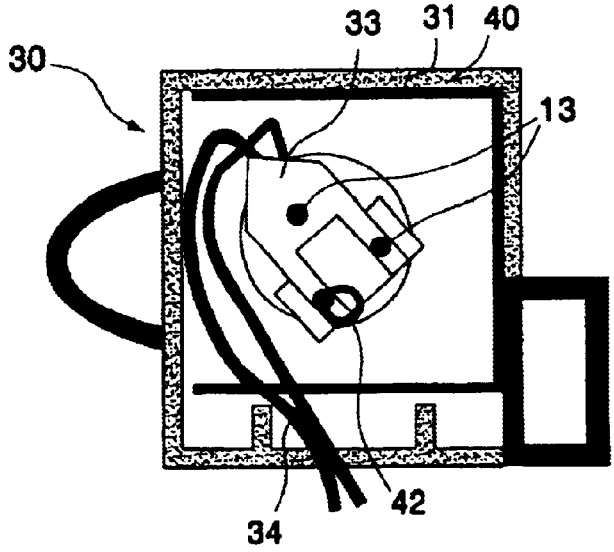
FIG. 2b PRIOR ART
FIG. 2*b* is a view schematically showing a configuration in which the conventional terminal assembly of FIG. 2*a* is mounted to a linear compressor.
Figure 3A:
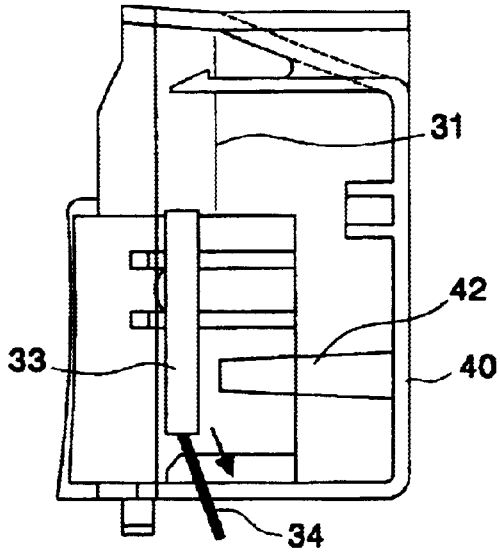
FIG. 3a PRIOR ART
FIG. 3*a* is a sectional view schematically showing the structure of the terminal assembly shown in FIG. 2*a;*
Figure 3B:
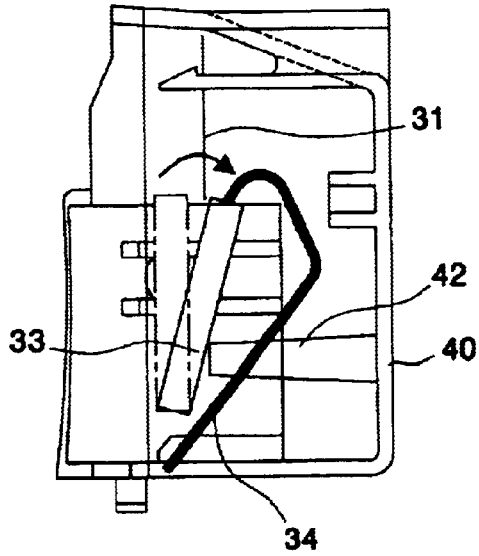
FIG. 3b PRIOR ART
FIG. 3*b* is a sectional view schematically showing the structure of the terminal assembly shown in FIG. 3*a;*
Figure 4:
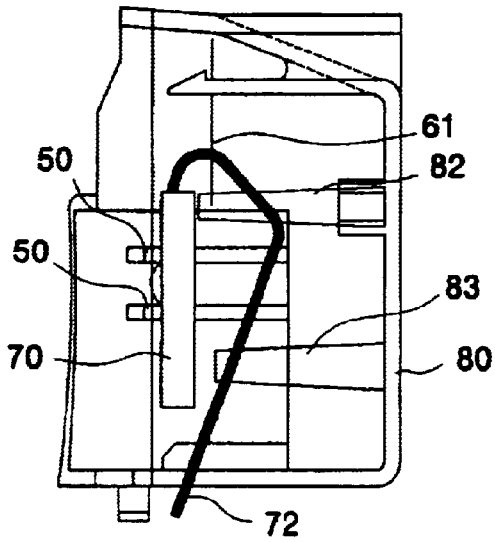
FIG. 4 is a sectional view schematically showing the structure of a terminal assembly for a compressor according to the present invention.
Figure 5A:
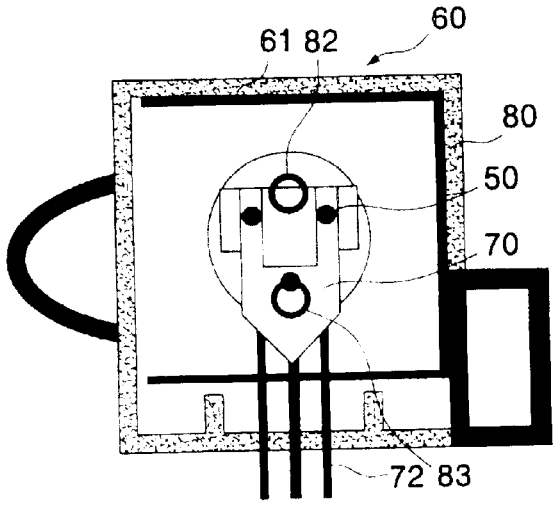
FIG. 5*a* is a view schematically showing a configuration in which the terminal assembly for the compressor according to the present invention is mounted to the reciprocating compressor.
Figure 5B:
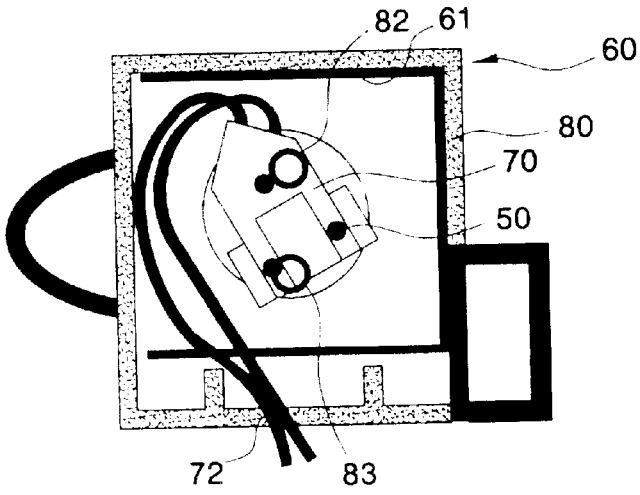
FIG. 5*b* is a view schematically showing a configuration in which the terminal assembly for the compressor according to the present invention is mounted to the linear compressor.

FIG. 4 shows a sectional view of the structure of the terminal assembly for the compressor according to the present invention, FIG. 5*a* is a view schematically showing a configuration in which the terminal assembly for the compressor according to the present invention is mounted to a reciprocating compressor; and FIG. 5*b* is a view schematically showing a configuration in which the terminal assembly for the compressor according to the present invention is mounted to a linear compressor.

Referring to these figures, the terminal assembly 60 according to the embodiment of the present invention comprises a terminal frame 61, a connector 70 and a cover 80. A variety of parts such as a PTC unit and a fuse unit (not shown) are mounted in the terminal frame 61.

The terminal assembly 60 of the embodiment is mounted on terminals 50 that are installed to penetrate a hermetic housing constituting an external appearance of the compressor. Of course, a protector surrounding the terminals 50 is mounted to the hermetic housing.

The terminal frame 61 constituting the terminal assembly 60 is formed to be seated in the protector. The connector 70 is placed on the terminal frame 61. An installation position of the connector 70 can be changed within the terminal frame 61. The installation position is determined according to positions of the terminals 50 that depend on the kinds of compressors.

For example, in case of the reciprocating compressor in which the respective terminals 50 are arranged at vertexes of an inverted triangle as shown in FIG. 5*a*, the connector is installed so that connection wires 72 extend directly toward a lower portion of the terminal frame 61. On the other hand, in case of the linear compressor in which the respective terminals 50 are arranged at vertexes of a triangle inclined leftward at a predetermined angle as shown in FIG. 5*b*, the connector is installed so that the connection wires 72 extend out from an upper left portion of the connector and then lead to the lower portion of the terminal frame.

Such a connector 70 electrically connects the terminals 50 to the connection wires 72 so that control signals can be transmitted out of and into the compressor and external electric power for driving the compressor can be supplied into the compressor.

Further, the PTC unit and the fuse unit in addition to the connector 70 are mounted in the terminal frame 61.

Meanwhile, the cover 80 is mounted on the terminal frame 61. The cover 80 functions to shield the terminal frame 61. Such a cover 80 may be mounted on the terminal frame 61 by means of an additional elastic structure formed in the cover itself or separate fastening screws.

An inner surface of the cover 80 is formed with restriction bosses 82, 83 for restricting play or movement of the connector 70 to prevent the connector 70 from being detached from the terminals. The restriction bosses 82, 83 are formed to be spaced apart from each other by a predetermined interval. That is, the restriction bosses 82, 83 are formed at the predetermined interval in a generally longitudinal direction of the connector 70 to restrict the detachment of the connector 70 even though the direction in which the connector 70 is mounted on the terminals 50 is changed. At this time, the interval between the restriction bosses 82, 83 should be shorter than the length of the connector 70.

Further, the restriction bosses 82, 83 are arranged in an up and down direction in the reciprocating compressor shown in FIG. 5*a*. In the present embodiment, the restriction bosses 82, 83 are formed such that there is a predetermined gap between the tips of the restriction bosses and the connector 70 when the cover 80 is mounted on the terminal frame 61. However, it is not always necessary to have the predetermined gap therebetween. The length of the restriction bosses 82, 83 may be designed so that they can come into close contact with a surface of the connector 70.

For reference, although two restriction bosses 82, 83 are formed in the present embodiment, two or more restriction bosses may be formed to restrict the detachment of the connector 70. The formation of two or more restriction bosses can be usefully employed in a case where the installation direction of the connector 70 is changed variously.

Hereinafter, the operation of the terminal assembly for the compressor according to the present invention constructed as such will be described in detail.

The present invention can effectively prevent the detachment of the connector 70 even though the installation direction of the connector 70 varies, by forming the plurality of restriction bosses 82, 83 on the inner surface of the cover 80.

That is, in the case where the terminal assembly 60 is mounted on an outer surface of the hermetic housing of the reciprocating compressor as shown in FIG. 5*a*, the connector 70 is installed so that the connection wires 72 extend downward and out of the terminal assembly 60.

At this time, as the cover 80 is mounted on the terminal frame 61, the restriction bosses 82, 83 are placed at positions corresponding to upper and lower ends of the connector 70. In such a state, the connector 70 is restricted from being detached by the restriction bosses 82, 83.

On the other hand, in the case where the terminal assembly 60 is mounted on an outer surface of the hermetic housing of the linear compressor as shown in FIG. 5*b*, the connector 70 is installed so that the connection wires 72 extend out from the upper left portion of the connector and toward the lower portion of and out of the terminal assembly 60.

The reason that the connector 70 should be installed in such a way is that the arrangement of the terminals 50 on the outer surface of the hermetic housing of the linear compressor is different from that of the reciprocating compressor. That is, as shown in FIG. 5*b*, the connector 70 is mounted on the terminals 50 so that the connection wires 72 of the connector 70 are placed at a relatively upper position. This is because the same terminal assembly 60 is commonly used for the reciprocating compressor and the linear compressor.

At this time, (assuming that a portion of the connector 70 to which the connection wires 72 are connected is a lower end thereof,) the restriction bosses 82, 83 restrict positions of the connector 70 corresponding to one side end portion of the upper end of the connector 70 and a diagonal end portion of the lower end of the connector 70.

Therefore, if the connection wires 72 are pulled out, the restriction boss 82 positioned at an upper position in the figures restricts the connector 70. Thus, the connector 70 is prevented from being detached from the terminals 50. The upper end of the connector 70 is prevented from being detached from the terminals 50 by the restriction boss 83.

The terminal assembly for the compressor according to the present invention described in detail above has the following effects.

Since at least two restriction bosses for restricting the detachment of the connector are formed on the cover of the terminal assembly of the present invention, the restriction bosses restrict the connector from being detached from the terminals regardless of the installation direction of the connector.

Therefore, even while the terminal assembly can be commonly used for the reciprocating compressor and the linear compressor of which the installation directions of the connector are different from each other, the state where the connector provided in the terminal assembly is connected to the terminals can be firmly maintained.

According to the present invention, there are advantages in that production costs and part management costs can be reduced owing to part sharing, and the operation reliability of the compressor can be improved owing to the firm connection state of the connector.

What is claimed is:

1. A terminal assembly for a compressor, comprising:

a protector with terminals electrically connected to parts within the compressor;

a connector mounted on the terminals for performing electrical connection between the terminals and connection wires;

a terminal frame which is mounted on an outer surface of a hermetic housing of the compressor and in which the connector is seated; and a cover which is mounted on the terminal frame for shielding parts installed in the terminal frame and has restriction bosses for restricting detachment of the connector, wherein the restriction bosses are formed at a predetermined interval on the cover so as to restrict detachment of the connector at opposite ends of the connector even when the connector is placed at a rotated position within the terminal frame.

2. The terminal assembly as claimed in claim 1, wherein the interval between the restriction bosses is smaller than a width between the opposite ends of the connector.

3. The terminal assembly as claimed in claim 1, wherein when the cover is mounted on the terminal frame, the restriction bosses come into contact with the connector at a maximum length of the restriction bosses.

* * * * *